US006902040B2

(12) United States Patent
Fujita et al.

(10) Patent No.: US 6,902,040 B2
(45) Date of Patent: Jun. 7, 2005

(54) ELEVATOR CAR

(75) Inventors: Yoshiaki Fujita, Tokyo (JP); Katsuyoshi Uchibori, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 196 days.

(21) Appl. No.: 10/416,519

(22) PCT Filed: Nov. 22, 2001

(86) PCT No.: PCT/JP01/10251

§ 371 (c)(1),
(2), (4) Date: May 23, 2003

(87) PCT Pub. No.: WO02/42195

PCT Pub. Date: May 30, 2002

(65) Prior Publication Data

US 2004/0050628 A1 Mar. 18, 2004

(30) Foreign Application Priority Data

Nov. 24, 2000 (JP) ..... 2000-357726

(51) Int. Cl.[7] ..... B66B 13/14
(52) U.S. Cl. ..... 187/314; 187/414
(58) Field of Search ..... 187/313, 314, 187/345, 401, 414; 454/68, 88; 62/244

(56) References Cited

U.S. PATENT DOCUMENTS 1,872,007 A * 8/1932 Reilly ..... 454/68
1,941,425 A * 12/1933 Young ..... 165/48.1
2,265,623 A * 12/1941 Bonsall ..... 454/88
2,305,141 A * 12/1942 Crede ..... 62/418
2,310,414 A * 2/1943 Fritzam ..... 454/68
2,350,389 A * 6/1944 Coulton et al. ..... 454/68
5,080,003 A * 1/1992 Kappeler ..... 454/68
5,306,208 A * 4/1994 Sommerrock et al. ..... 454/68
5,454,449 A * 10/1995 Makimattila et al. ..... 187/401
6,615,952 B2 * 9/2003 Itoh et al. ..... 187/249

FOREIGN PATENT DOCUMENTS

DE 171 424 5/1906
EP 0 212 147 3/1987
JP 01281276 A * 11/1989 ..... B66B/5/00

* cited by examiner

*Primary Examiner*—Jonathan Salata
(74) *Attorney, Agent, or Firm*—Oblon, Spivak, McClelland, Maier & Neustadt, P.C.

(57) ABSTRACT

An exit (5) formed in an elevator car (1) is closed by doors (8) of multi-construction including an inner door (6) and an outer door (7). Air is able to flow between a space between the inner door (6) and the outer door (7) and the space in the elevator car (1). The elevator car (1) can be sealed in an airtight state and can be isolated from external noise. Deformation of the decorative inner surface of the inner door (6) by pressure difference between the interior and the exterior of the elevator car (1) can be prevented.

16 Claims, 12 Drawing Sheets

ELEVATOR CAR

BACKGROUND OF THE INVENTION

1. Field of the Invention

The present invention relates to an exit structure included in an elevator cage provided with a pressure control system for controlling pressure in the cage or included in an airtight elevator cage sealed to secure a silent space therein.

2. Description of the Related Art

Recently, a rapid elevator is installed in a skyscraper to meet the requirement of nonstop and high-speed transportation to upper floors. An elevator cage of such rapid elevator is provided with a pressure control system to maintain a space in the cage at a predetermined pressure, thereby avoiding rapid pressure change in the cage for the passengers' comfort. The walls of a conventional elevator cage are single-wall panels and hence it is difficult to maintain the space in the cage at a fixed pressure. When the pressure in the cage is controlled, the decorative inner surfaces of the walls of the cage are strained by pressure difference between the interior and the exterior of the cage. Some elevator cage have walls formed of double-wall panels assembled in airtight construction to maintain a set pressure in the cage and to isolate the space in the cage from external noise.

The elevator cage is provided with an exit normally closed by a door to enable passengers to escape from the cage in an emergency, such as failure in power supply. The exit must be opened when necessary. Therefore, gaps are formed between a structure defining the exit and the door, and hence it is impossible to prevent air flow between the interior and the exterior of the cage.

SUMMARY OF THE INVENTION

Accordingly, it is an object of the present invention to provide an elevator cage provided with an exit normally closed by a door, and capable of preventing air flow between the interior and the exterior thereof through the exit, of efficiently controlling pressure therein, of satisfactorily isolating the space therein from external noise and of preventing the adverse effect of the variation of the pressure therein on the decorative inner surface of the walls thereof.

To achieve the objectives, the present invention provides an elevator car including: an elevator cage having a plurality of walls defining an interior space for passengers, the wall including an outer wall element and an inner wall element, the outer and the inner wall elements of one of the walls being provided respectively with openings forming an exit; an outer door that hermetically closes the opening of the outer wall element; and an inner door that covers the opening of the inner wall element but allows air to flow between the enclosed space and a space between the outer door and the inner door when the inner door is closed.

The inner door and the inner wall element may be configured so that a gap is formed between the inner door and the inner wall element when the inner door is closed, and the gap allows the air to flow between the interior space of the cage and a space between the inner and the outer door.

When the exit is provided in a side wall, the gap is preferably formed adjacent to a platform of the cage.

The inner and the outer doors may be connected with each other via a connecting member so that the inner and the outer doors move together. The connecting member is preferably made of vibration isolating member.

BRIEF DESCRIPTION OF THE DRAWINGS

FIGS. 12(*c*) and 12(*d*) are a sectional view and a side elevation, respectively, of an outer door support mechanism;

DESCRIPTION OF THE PREFERRED EMBODIMENTS

Preferred embodiments of the present invention will be described with reference to the accompanying drawings.

Figure 1:
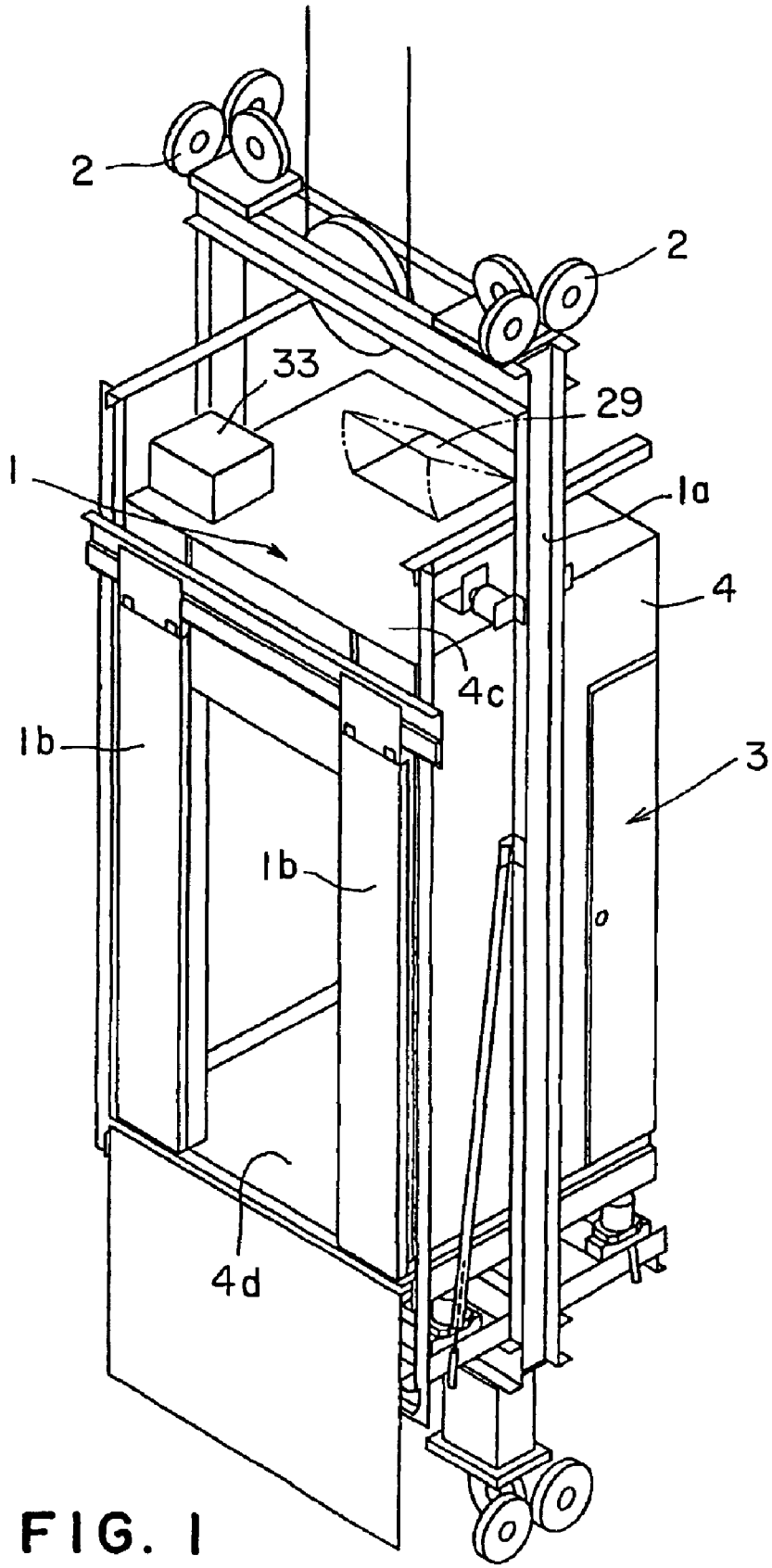
FIG. 1 is a perspective view of an elevator car provided with an exit structure according to the present invention.

Referring to FIG. 1 showing an elevator car according to the present invention, the elevator cage 1 is held on a frame la provided with a guide device 2 at each of its four corners. The guide devices 2 are engaged with guide rails (not shown) installed in an elevator shaft to guide the elevator car for vertical movement along the not-shown guide rails. An exit structure 3 is incorporated into one of the side walls 4 of the cage 1 to enable persons to escape from the cage 1 when the elevator comes to an accidental standstill due to power failure or the like. The cage 1 is provided with car doors 1*b* that hermetically closes the entrance of the cage 1.

Figure 2:
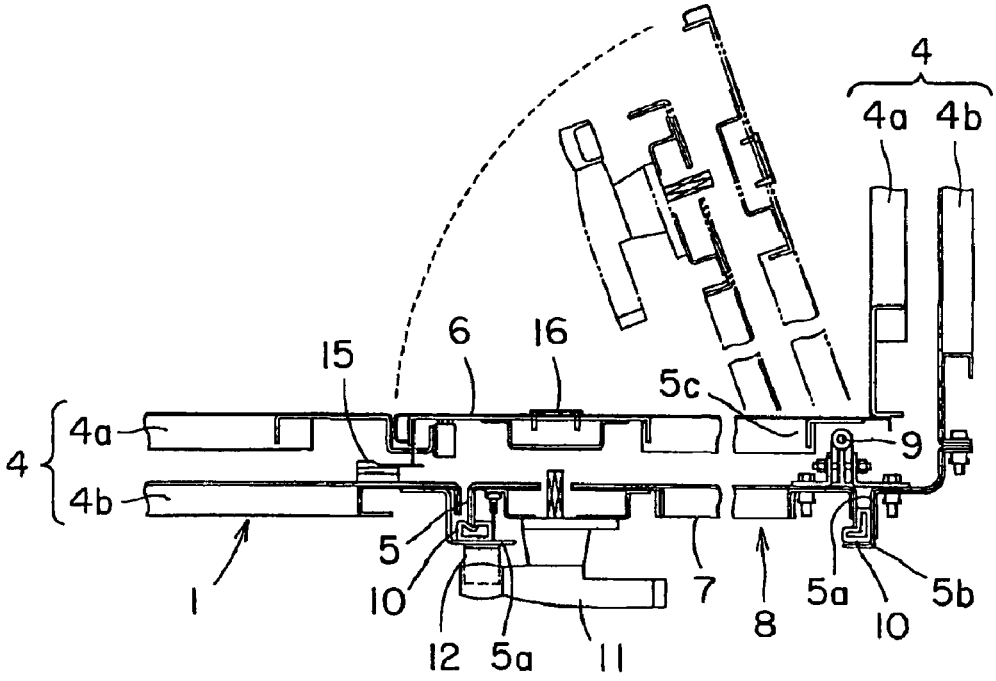
FIG. 2 is a sectional plan view of the exit structure of the cage shown in FIG. 1.

The cage 1 is formed by assembling a plurality of walls. The plurality of walls include side walls 4 (vertical walls), a top wall 4*c* (ceiling of the cage 1) and a bottom wall 4*d* (platform of the cage 1). Referring to FIG. 2 showing the exit structure 3 in a sectional plan view, each of the side walls 4 has a double-wall panel structure, namely, is composed of an interior panel (i.e., inner wall element) 4*a* and an exterior panel 4*b* (i.e., outer wall element). The top and the bottom walls 4*c*, 4*d* also may be of the double-wall panel structure. The interior and exterior panels 4*a*, 4*b* of one of the side walls 4 are provided with openings 5*c*, 5*a*, respectively, to form an exit 5. The exit 5 is closed by doors 8 including an inner door 6 and an outer door 7. The outer door 7 is pivotally attached to the exterior panel 4*b* via hinges 9, which are disposed in a space between the inner door 6 and the outer door 7. The outer door 7 can be turned on the vertical axis of the hinge 9 to open inward. The inner door 6 is pivotally supported on the interior panel 4*a* for inward turning about an axis aligned with the vertical axis of the hinge 9.

A frame 5*b* having an L-shaped cross section is arranged around the opening 5*a* (of the exit 5) of the exterior panel 4*b*, and is fixed to the exterior panel 4*b*. A door gasket 10 is attached to the inner periphery of the frame 5*b*. When closed, the outer periphery of the outer door 7 comes into close contact with the door packing 10 to seal hermetically a gap between the exterior panel 4*b* and the outer door 7.

Figure 3:
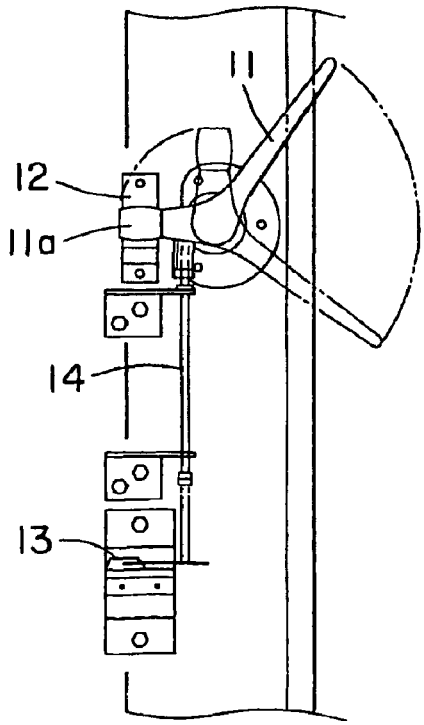
FIG. 3 is a front elevation of a handle shown in FIG. 2.

As shown in FIG. 3, a handle 11, provided with a locking arm 11*a*, is fixed on the outer surface the outer door 7. When the handle 11 is placed at a locking position indicate by continuous lines, the locking arm 11*a* engages with a stopping member 12 attached to the outer surface of the frame 5*b*. In this state, the frame 5*b* and the packing 10 placed thereon are held between the locking arm 11*a* and the outer door 7, and thus the outer door 7 is held at a closed position in which the opening 5*a* of the exit 5 is hermetically closed by the outer door 7. A door switch 13 for detecting the position of the outer door 7 and an actuating rod 14 for operating the door switch 13 are attached to the outer surface of the frame 5*b*. When the handle 11 is placed at the locking position indicate by continuous lines, the rod 14 operates the door switch 13 to produce a door-closed signal indicating that the outer door 7 is closed.

As shown in FIG. 2, a door switch 15 is attached to the inner surface of the exterior panel 4*b* so as to be operated by the inner door 6. When the inner door 6 is closed, the door switch 15 is operated by the inner door 6 to generate a door-closed signal indicating that the inner door 6 is closed. A tool inserting hole 16 is formed in the inner door 6 to manually operate the handle 11.

Figure 4:
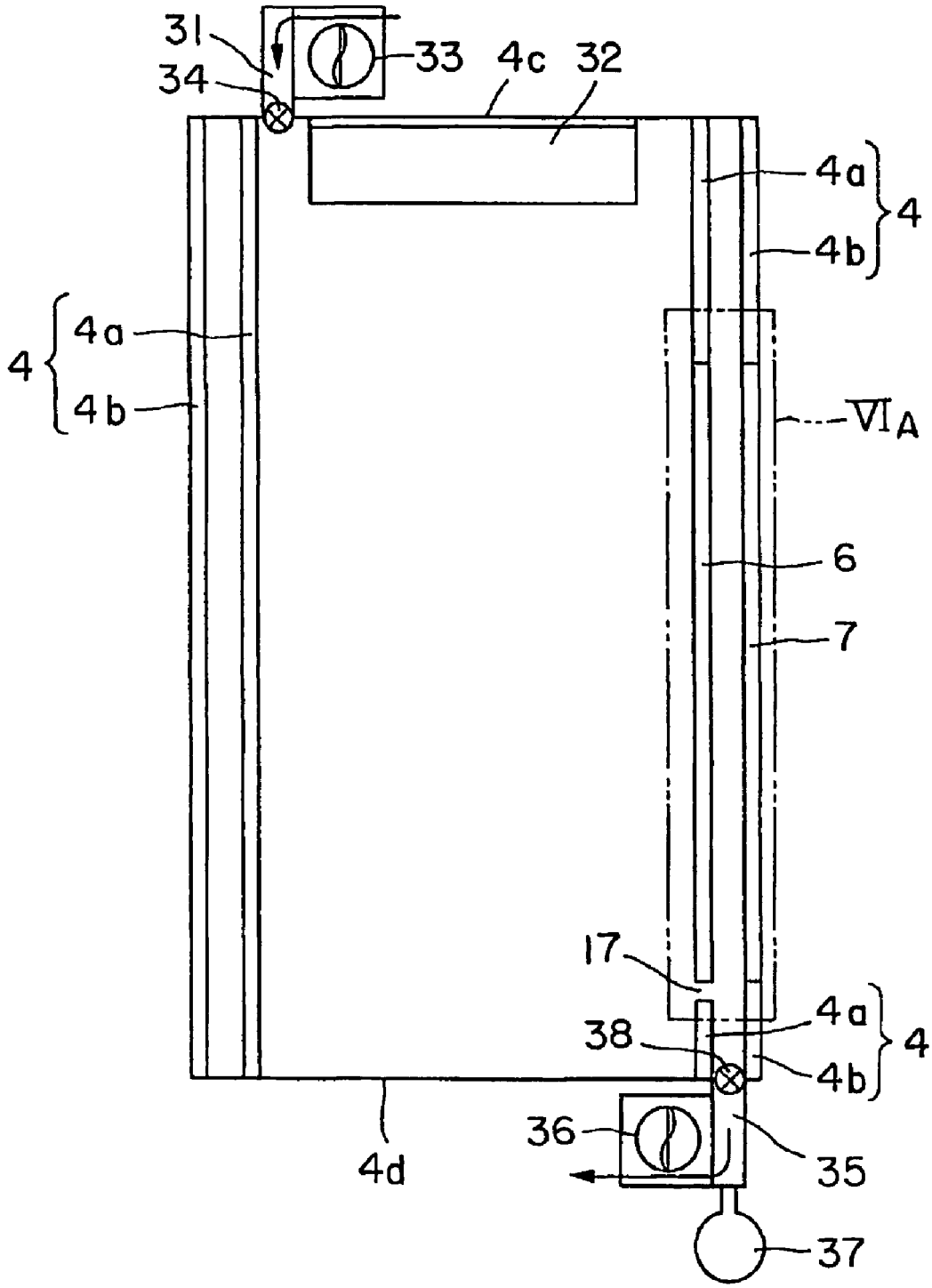
FIG. 4 is a longitudinal sectional view of a cage shown in FIG. 1, which schematically shows internal structure of the cage and devices for controlling pressure in the cage.

Referring to FIG. 4 schematically showing the cage 1 in a longitudinal sectional view, connected to the top of the cage 1 is an upper duct 31, which opens into the interior space of the cage 1 at a position between a ceiling-lighting fixture 32 and the side wall 4. An upper fan 33, for introducing air into the interior space of the cage 1, is attached to the duct 31. A check valve 34, which exclusively allows air to flow from the exterior space to the interior space of the cage 1.

Connected to the bottom of the cage 1 is a lower duct 35, which opens into the space between the interior panel 4*a* and the exterior panel 4*b*. A bottom fan 36 for discharging air in the cage 1 and a rapture disk 37 is attached to the duct 35. The duct 35 is provided with a solenoid valve 38 to open and close the duct 35.

When pressurizing the interior space of the cage 1, the upper fan 33 operates to introduce air into the interior space of the cage 1. Thereupon, air in the interior space of the cage 1 flows into the space between the inner door 6 and the outer door 7 through a gap 17 or an air passage formed between the lower edge of the inner door 6 and the interior panel 4*b*, and thus flows into the space between the interior panel 4*a* and the exterior panel 4*b*.

Since the outer door 7 hermetically closes the opening 5*a*, air in the space between the interior panel 4*a* and the exterior panel 4*b* does not leak. In addition, the car doors 1*b* hermetically closes the entrance of the cage 1, air in the interior space of the cage 1 does not leak. Accordingly, pressure in the space between the inner door 6 and the outer door 7 substantially the same as that in the interior space of the cage 1, but is higher than that in the exterior space of the cage 1.

When depressurizing the interior space of the cage 1, the bottom fan 36 operates to discharge air from the interior space of the cage 1 through the gap 17.

In case of an accident, such as power failure of the elevator system or emergency stop of the elevator car, the solenoid valve 38 is opened to equalize pressures in the interior and the external spaces of the cage 1. The rupture disk 37 avoids rapid change in pressure in the interior space of the cage 1.

Figure 4A:
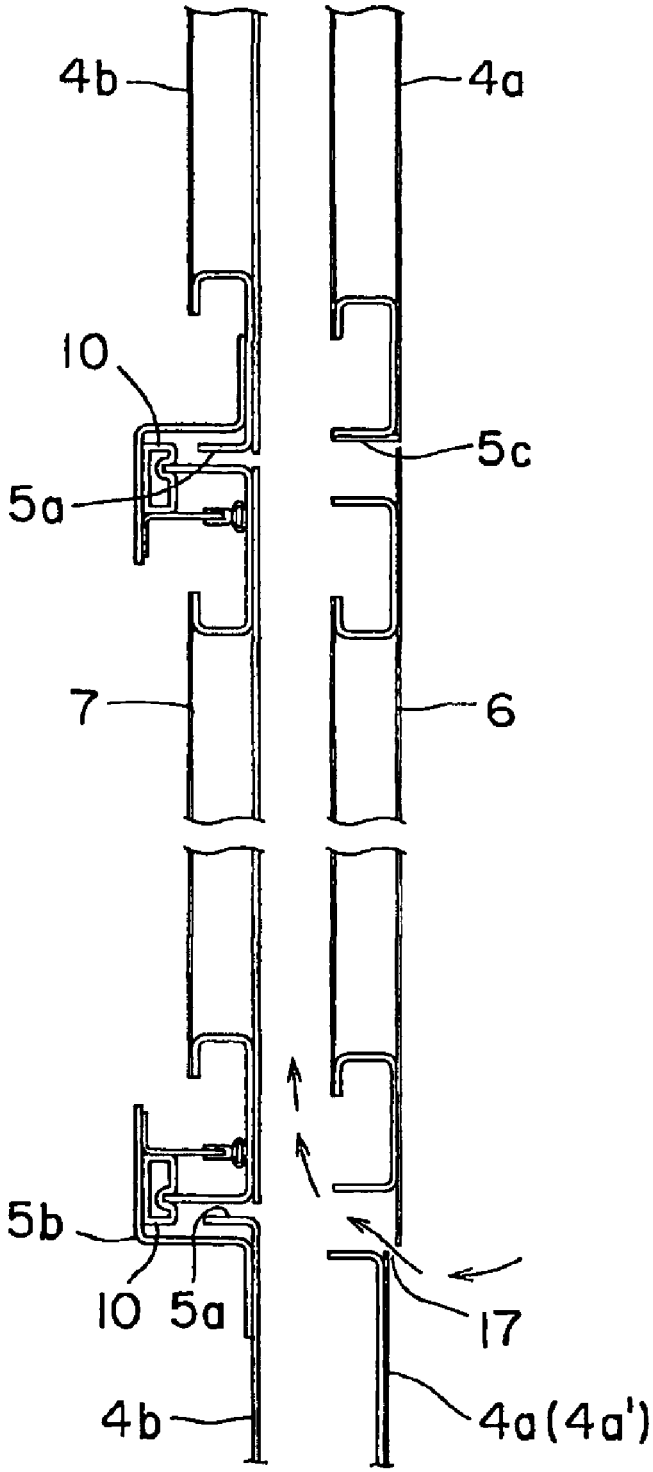
FIG. 4A is a longitudinal sectional view of the exit structure shown in FIG. 2.

Referring to FIG. 4A showing the exit structure in a longitudinal sectional view in detail, a gap 17 or an air passage is formed between the lower edge of the inner door 6 and the interior panel 4*a*. The gap 17 permits air to flow from the interior space of cage 1 into the space between the inner door 6 and the outer door 7. Since the gap 17 is formed adjacent to a platform 4*d* of the cage 1, passengers do not notice that the gap 17 exists. In FIG. 4A, the bottom part of the interior panel 4*a* indicated by reference numeral 4*a*' is a part of the interior panel 4*a* providing a decorative surface of the interior panel 4*a*, however, the part 4*a*' may be a baseboard. Such baseboard should be interpreted as a part of the interior panel 4*a* of the side wall 4 in this specification.

As mentioned above, when the openings 5*c* and 5*a* are closed by the doors 6, 7, respectively, the interior space in the elevator cage 1 and the space between the inner door 6 and the outer door 7 are maintained at the same pressure because those spaces communicate with each other by means of the gap 17, and the gap between the periphery of the outer door 7 and the exterior panel 4*b* is sealed with the door packing 10. Thus, the elevator cage 1 is sealed hermetically and the pressure in the elevator cage 1 is controllable, and the interior of the elevator cage 1 is isolated from noise generated by the moving elevator cage 1. Sealing engagement between the outer door 7 and exterior panel 4*b* using the packing 10 achieves noise reduction of −2 to −3 dB in the elevator cage 1.

Since the space in the elevator cage 1 and the space between the inner door 6 and the outer door 7 are maintained at the same pressure, only the outer door 7 is affected by the pressure difference between the interior and the exterior of the elevator cage 1, and hence the decorative inner surface of the inner door 6 will not be strained by the pressure difference.

Since the positions of the inner door 6 and the outer door 7 are detected by the door switches 13 and 15, respectively, the vertical movement of the elevator cage 1 with either of the inner door 6 or the outer door 7 in an open state is inhibited to ensure the safety of passengers in the elevator cage 1.

In case of an accident, such as power failure, occurs, the handle 11 is operated from outside the cage 1 to turn the inner door 6 and the outer door inward to positions indicated by two-dot chain lines in FIG. 2 to open the exit 5. The doors 6 and 7 can be unlocked and opened by inserting a handle turning tool in the tool inserting hole 16 from inside the cage 1 and turning the handle 11 with the handle turning tool.

In view of reducing wind noise that is generated by the moving elevator cage 1, it is preferable to reduce unnecessary projections projecting outward from the cage 1 as much as possible and to form the elevator cage 1 in a structure having flat surfaces. To this end, the hinge 9 suspending the outer door 7 on the exterior panel 4*b* is disposed in the space between the inner door 6 and the outer door 7 so that the hinge 9 does not project outside and the transmission of unpleasant noise to the interior of the elevator cage 1 is reduced.

Figure 5:
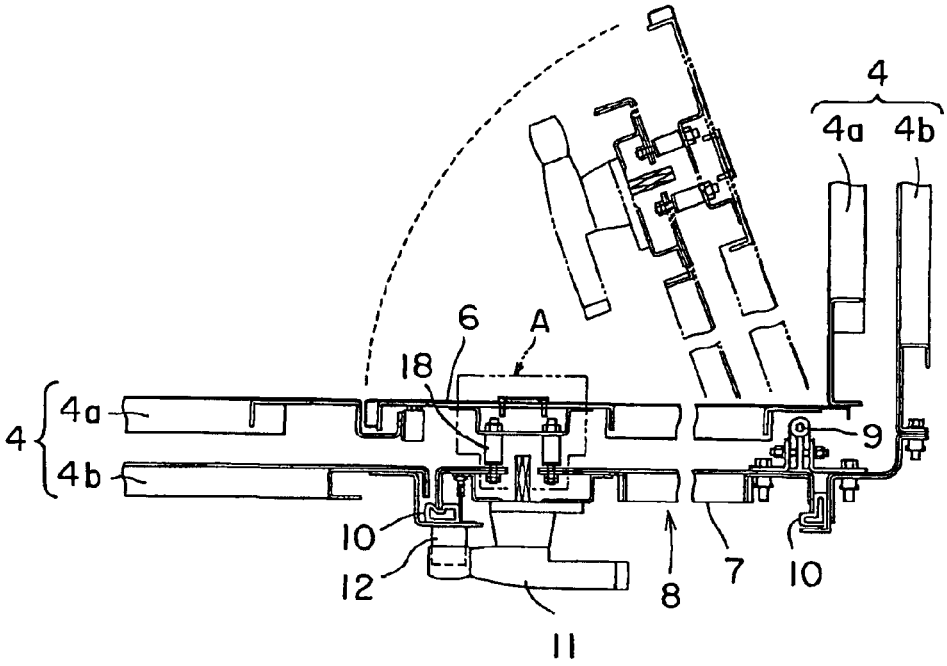
FIG. 5 is a sectional plan view of another embodiment of the exit structure.

Referring to FIG. 5 showing another embodiment of the exit structure, the inner door 6 and the outer door 7 are united by connecting members 18. Thus, the inner door 6 and the outer door 7 can be simultaneously opened and closed in a body, and hence only one door switch for providing a signal to inhibit the vertical movement of the elevator car with the inner door 6 and the outer door 7 in an open state may be provided in connection with either the inner door 6 or the outer door 7, which is effective in reducing the cost of the exit structure.

Preferably, the connecting members 18 are made of vibration isolating members. The vibration isolating members prevent the outer door 7 from being strained when the pressure in the elevator cage 1 is controlled and the transmission of vibrations of the outer door 7 to the inner door 6 when the elevator cage 1 moves.

Figure 5A:
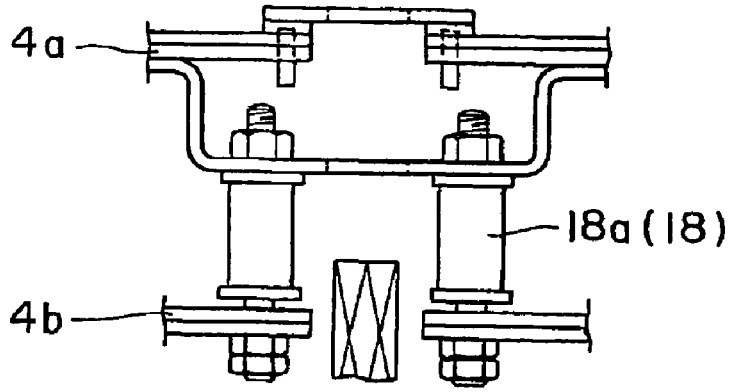
FIGS. 5A to 5C are enlarged views of the area A of FIG. 5, which shows connecting members.

As shown in FIG. 5A, the connecting member 18 may be made of rubber vibration isolator 18*a,* such as neoprene rubber. Silicon rubber, which is very flexible, may be used instead of neoprene rubber.

Figure 5B:
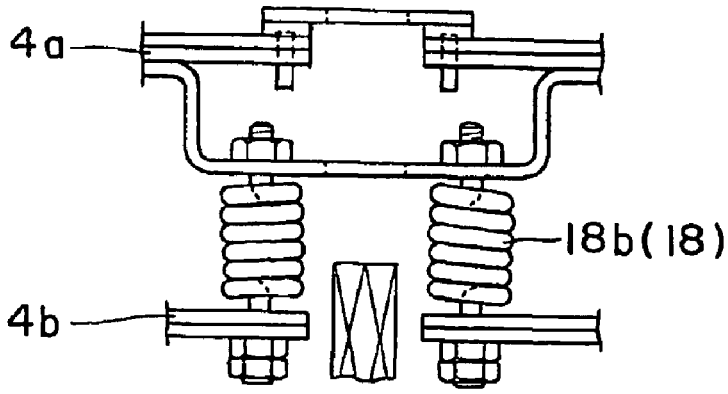

Alternatively, as shown in FIG. 5B, the connecting member 18 may be made of a spring 18*b,* which has vibration isolating function and is also durable.

Figure 5C:
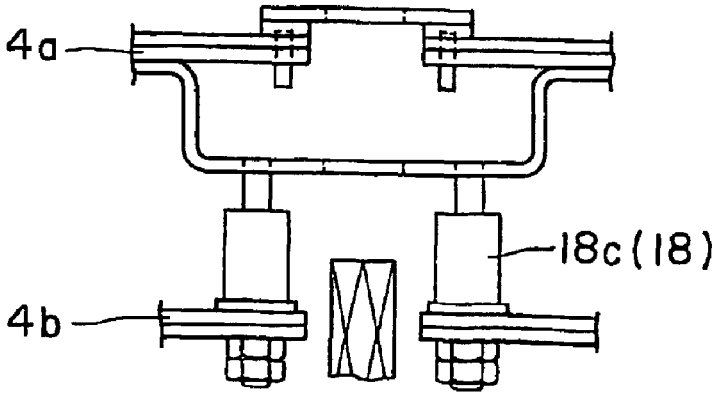

Alternatively, as shown in FIG. 5C, the connecting member 18 may be an oil damper 18*c,* which has a cylinder connected to one of the panels 4*a,* 4*b* (exterior panel 4*b*) and a rod connected to the other of the panels 4*a,* 4*b* (interior panel 4*a*). The oil damper 18*c* shows a good vibration isolating performance even if the amplitude of the vibration is large.

In the embodiments shown in FIGS. 2 and 5, the inner door 6 and the outer door 7 open inward, and the area of the outer door 7 may be smaller than that of the inner door 6. Since the outer door 7 having a smaller area has a higher rigidity, the outer door 7 having a small area can be easily brought into close contact with the exterior panel 4*b* and hence the number of necessary sealing members can be reduced. The small outer door 7 will not interfere with parts attached to the outer surface of the elevator cage 1.

Figure 6:
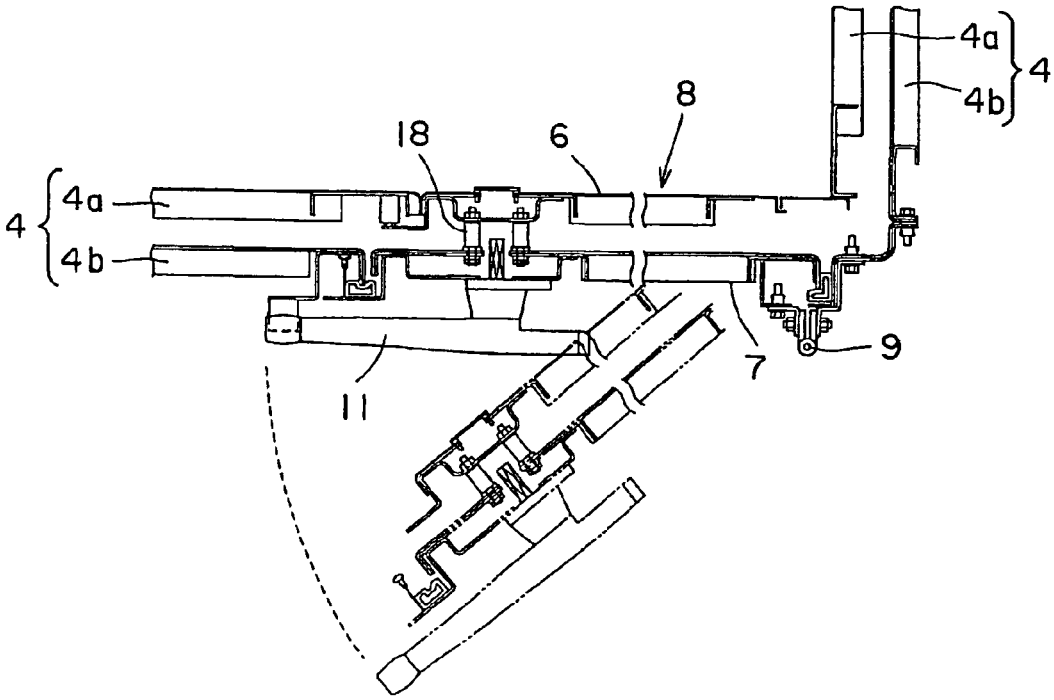
FIG. 6 is a sectional plan view of another embodiment of the exit structure.

Alternatively, as shown in FIG. 6, the inner door 6 and the outer door may be supported for outward opening on an elevator cage 1. In this exit structure, the inner door 6 may be formed in an area smaller than that of the outer door 7. The inner door 6 having a small area improves design for the interior of the elevator cage 1 and increases the degree of freedom of determining the position of an exit 5.

Figure 7:
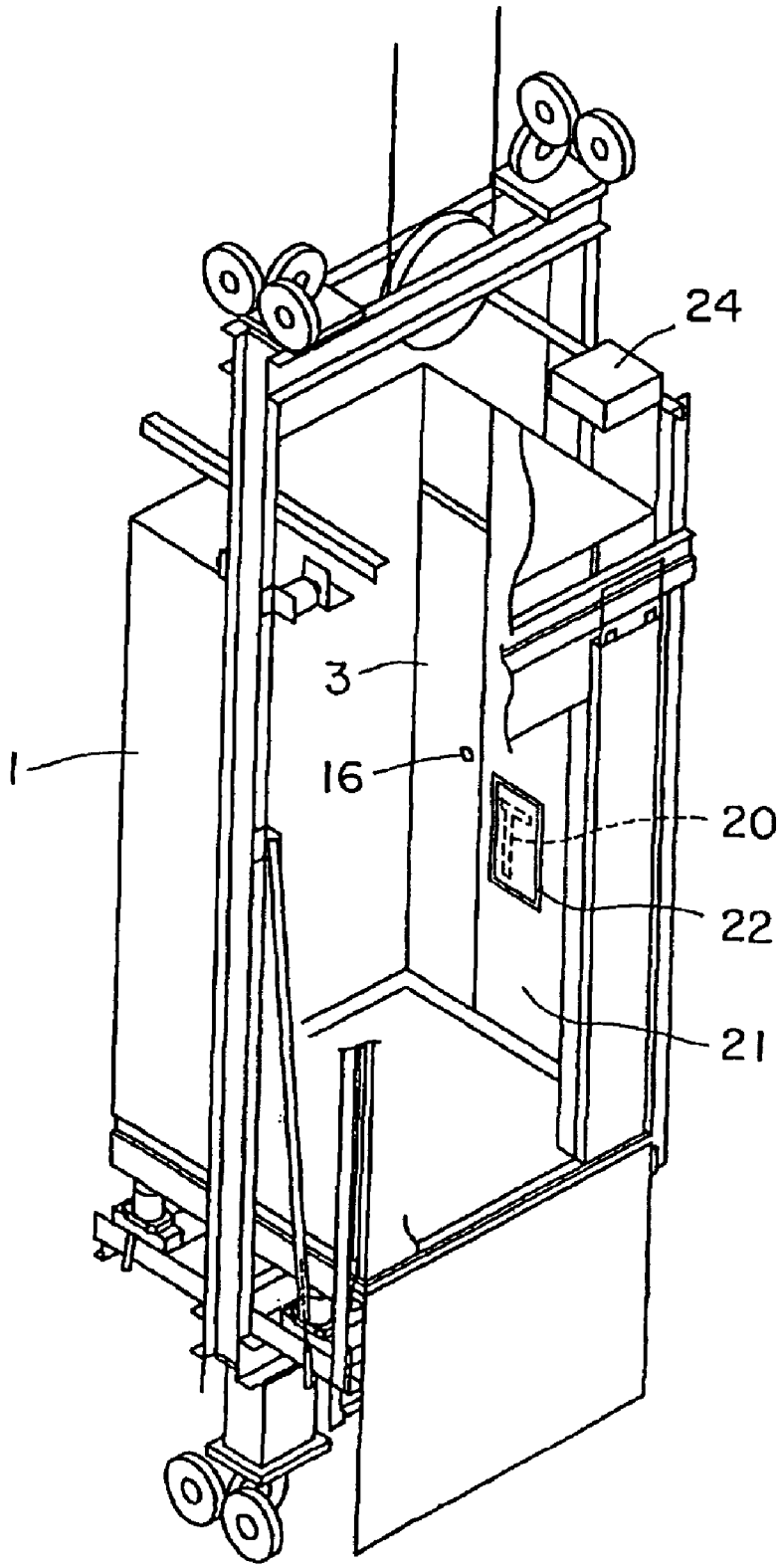
FIG. 7 is a perspective view of an elevator car provided with a handle-turning-tool storage structure therein.
Figure 8:
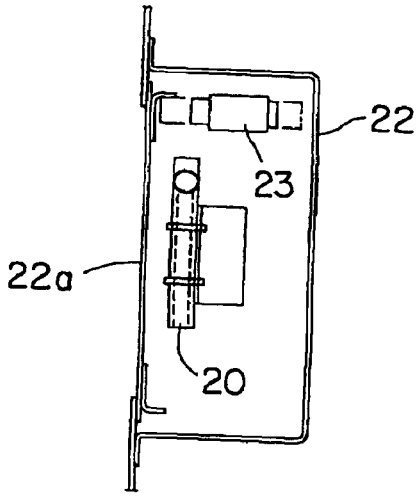
FIG. 8 is a sectional view of the handle-turning-tool storage structure of FIG. 7.
Figure 9:
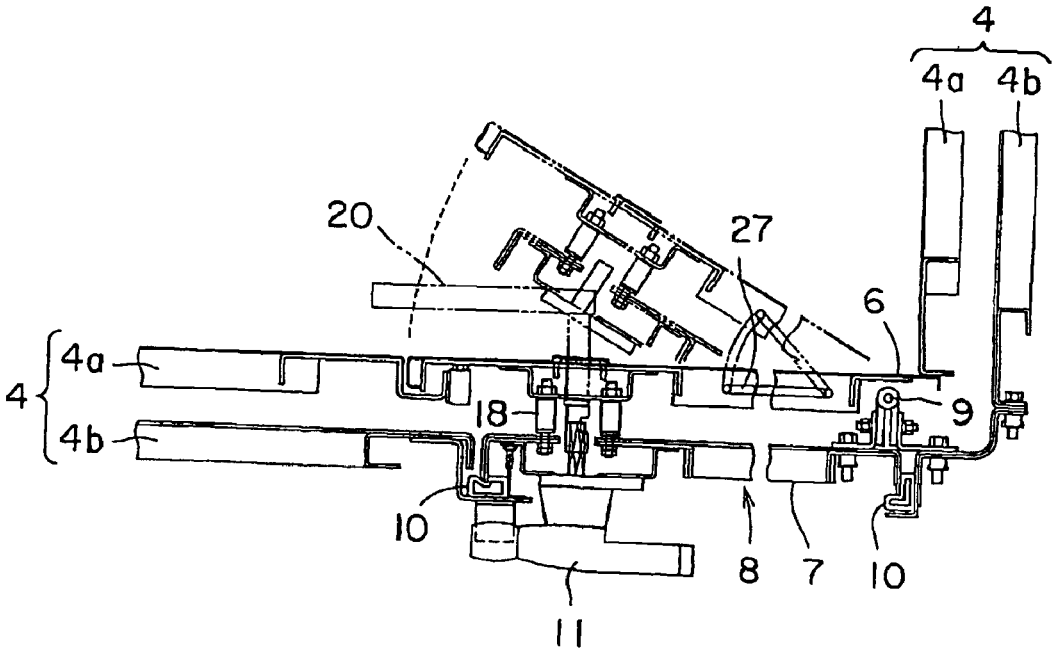
FIG. 9 is a sectional view of assistance in explaining a method of manually opening doors included in an exit structure from inside the elevator car.

Fresh air cannot be supplied into the airtight elevator cage 1 when the elevator is brought accidentally to a standstill by power failure or the like. In such a case, instructions to be followed by passengers in the elevator cage 1 are announced by a loudspeaker placed in the elevator cage 1. Then, the passenger in the elevator cage 1 turns the handle 11 with a handle turning tool 20 inserted in the tool inserting hole 16 to open the doors 6, 7 inward. As shown in FIG. 7, a tool storage structure 22 is formed in an inner wall 21 (4*a*) to store the handle turning tool 20 therein. As shown in FIG. 8, a solenoid actuator 23 restrains a door 22*a* included in the tool storage structure 22 from opening while the elevator is in normal operation and hence the handle turning tool 20 cannot be taken out of the tool storage structure 22. When power failure occurs, the solenoid actuator 23 becomes inoperative to release the door 22*a*. Consequently, the door 22*a* can be opened and the handle turning tool 20 can be taken out of the tool storage structure 22. The handle turning tool 20 is used for unlocking the door 7. Then, the doors 6, 7 can be opened by hand.

Figure 10:
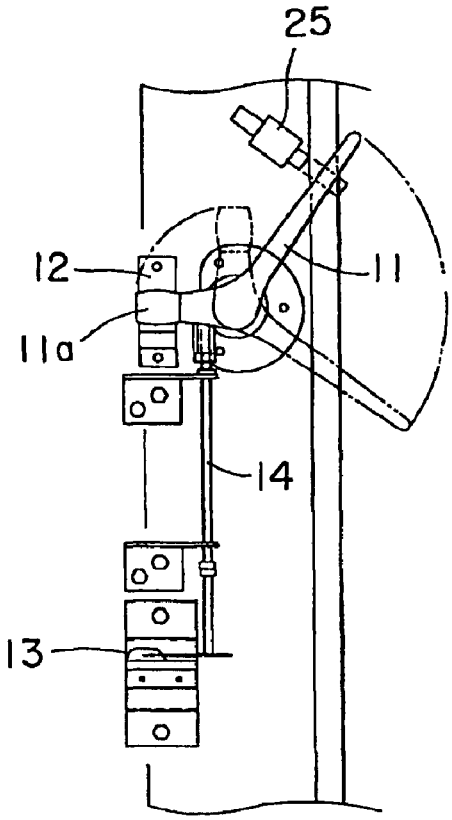
FIG. 10 is a side elevation of an automatic door opening mechanism for opening the doors of the exit structure.
Figure 11:
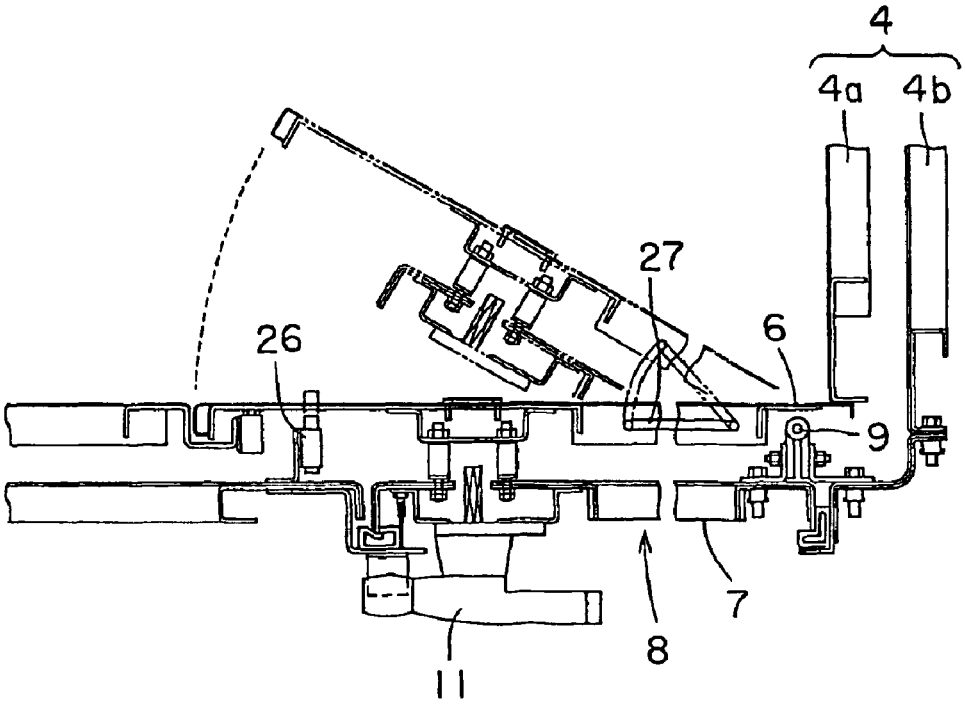
FIG. 11 is a sectional plan view of the automatic door opening mechanism.

An auxiliary power supply 24 may be held above the elevator cage 1 as shown in FIG. 7 to open the doors 6, 7 automatically by using power supplied by the auxiliary power supply 24. As shown in FIG. 10, a solenoid actuator 25 is supported on the exterior panel 4*b* opposite to the handle 11. The solenoid actuator 25 is energized by power supplied by the auxiliary power supply 24. As shown in FIG. 11, an inner door operating solenoid actuator 26 is supported on the inner surface of the exterior panel 4*b* opposite to the inner door 6.

When power supply to the power system of the elevator is interrupted due to power failure or the like, the auxiliary power supply 24 supplies power to the solenoid actuator 25, and then the solenoid actuator 25 turns the handle 11 in an unlocking direction. Power is supplied to the solenoid actuator 26 immediately after the supply of power to the solenoid actuator 25, and then the solenoid actuator 26 pushes the inner door 6 into the elevator cage 1 to pen the inner door 6 and the outer door 7 automatically. Consequently, fresh air can be supplied through the elevator shaft into the elevator cage 1. The inner door 6 is connected to the interior panel 4*a* by a door stopper 27. The door stopper limits the opening angle of the inner door 6 to a predetermined angle to ensure that persons are prevented from falling off the elevator cage 1 when the inner door 6 and the outer door 7 are opened. The door stopper 27 can be removed when the passengers escape through the exit from the elevator cage 1.

Figure 12:
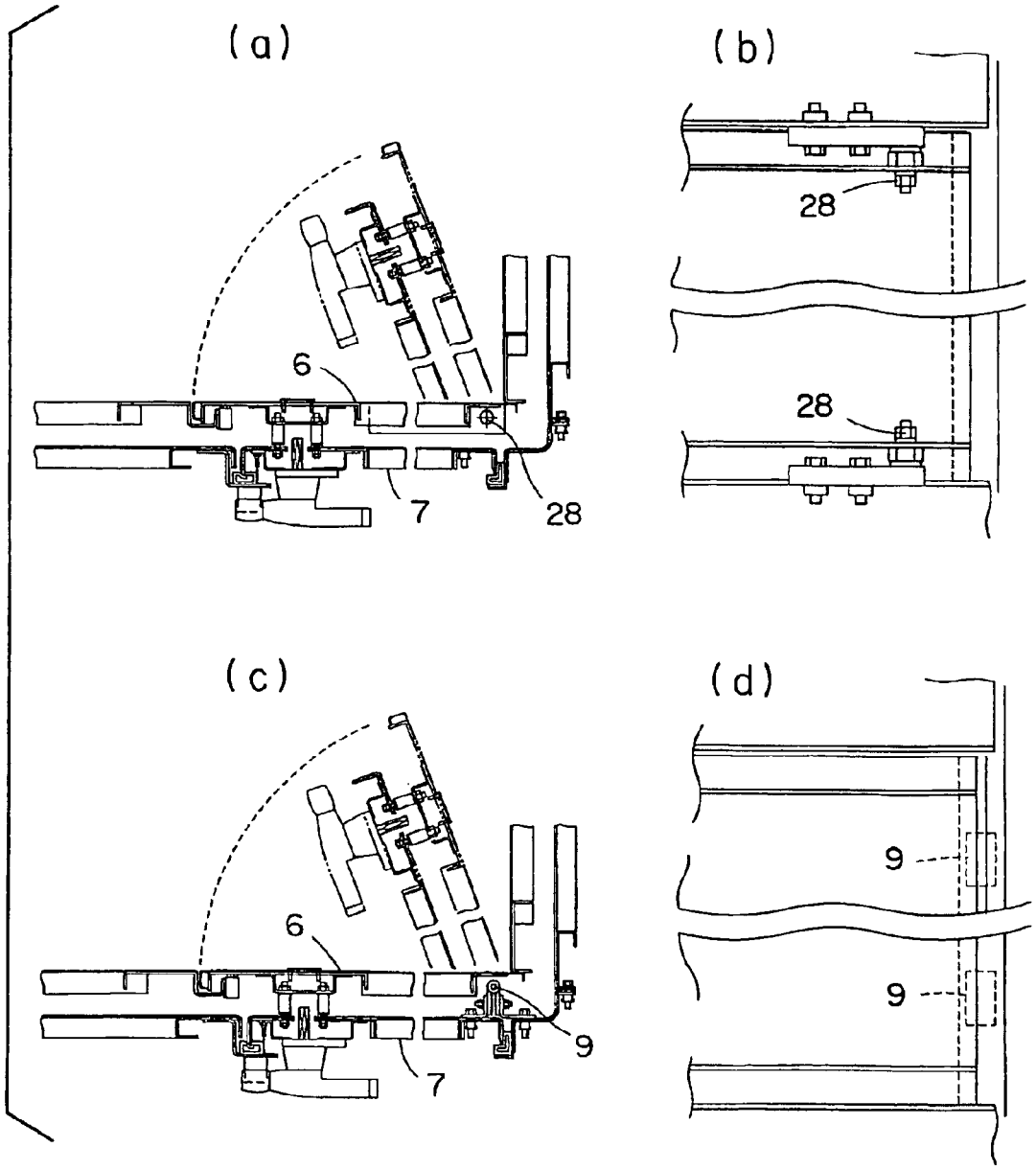
FIGS. 12(*a*) and 12(*b*) are a sectional view and a side elevation, respectively, of an inner door support mechanism.

FIGS. 12(*a*) to 12(*d*) show comparatively door support structures respectively suspending the inner door 6 and the outer door 7. As shown in FIGS. 12(*a*) and 12(*b*), the inner door is supported for turning by bearings 28*a* on the interior panel 4*a*. As shown in FIGS. 12(*c*) and 12(*d*), outer door 7 is supported for turning by hinges 9 disposed between the bearings 28*a* on the interior panel 4*a* and coaxial with the bearings 28*a;* that is, the inner door 6 and the outer door 7 have a common axis of turning. The common axis of turning of the inner door 6 and the outer door 7 extends near the decorative surface (inner surface) of the inner door 6 and apart from the outer door 7. Thus, it is easy to install the inner door 6 with its inner surface extended substantially flush with the inner surface of the interior panel 4*a*. Since the sealing surfaces of the outer door 7 and the exterior panel 4*b* are spaced from the axis of turning of the outer door 7, parts of the sealing surfaces near the hinges 9 can firmly compress the door gasket and hence the elevator cage 1 can be sealed in a sufficiently airtight state.

Figure 14:
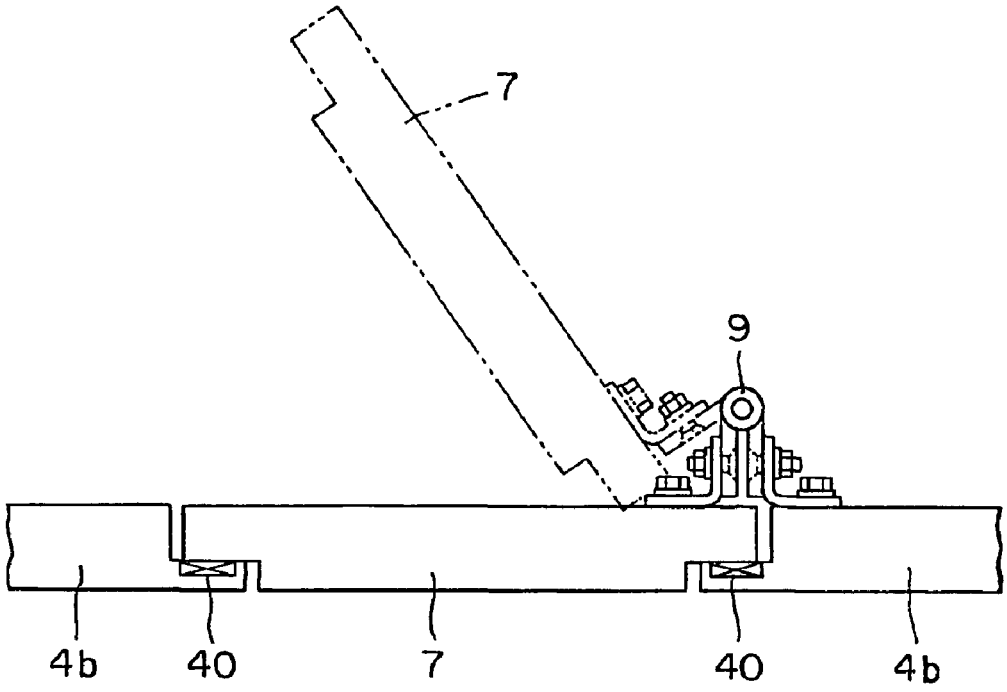
FIG. 14 is a sectional plan view of an exit structure, in which an electromagnet is used as sealing means in place of packing.

FIG. 14 shows another structure for establishing sealing engagement between the outer door 7 and the exterior panel 4*a*. The outer door 7 and the exterior panel 4*a* are configured so that the contacting surfaces thereof are disposed in plane-parallel face-to-face relationship with each other when the outer door 7 is closed. An electromagnet 40 attracts outer door 7 so that the outer door 7 engages with the exterior panel 4*a* hermetically.

Figure 13:
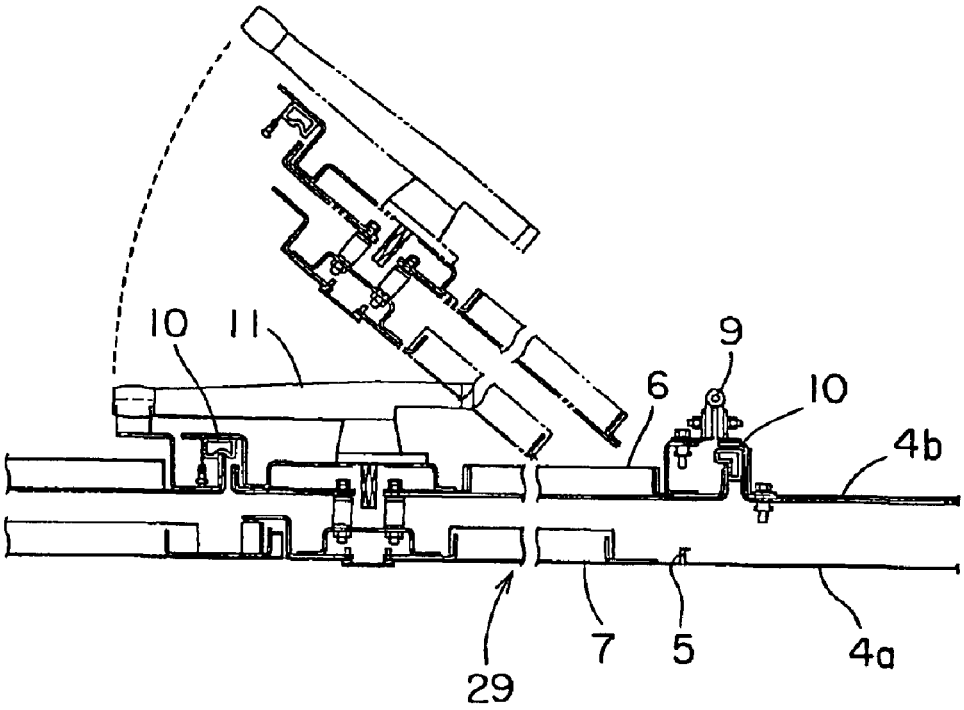
FIG. 13 is a sectional plan view of an exit structure incorporated into the ceiling of an elevator cage.

The construction of the foregoing exit structures according to the present invention can be applied to an exit structure 29 formed in the ceiling of the elevator cage 1 as shown in FIGS. 1 and 13. The exit structures may also be applied to cages of double-deck elevators. Preferably, an upper cage of a double-deck elevator is provided with the foregoing exit structure in its platform (floor of the cage).

The exit structures are also applicable to elevators located outdoor, preventing penetration of rainwater, snow and wind into the interior space of the cage. It is possible that the exterior panel rusts doe to the raindrops, however, the decorative surface of the interior panel will never be adversely affected.

What is claimed is:

1. An elevator car comprising:

an elevator cage having a plurality of walls defining an interior space for passengers, the wall including an outer wall element and an inner wall element, the outer and the inner wall elements of one of the walls being provided respectively with openings forming an exit;

an outer door that hermetically closes the opening of the outer wall element; and an inner door that covers the opening of the inner wall element but allows air to flow between the interior space and a space between the outer door and the inner door when the inner door is closed.

2. The elevator car according to claim 1, wherein a gap is formed between the inner door and the inner wall element when the inner door is closed, and the gap allows the air to flow between the interior space of the cage and a space between the inner and the outer door.

3. The elevator car according to claim 2, wherein the exit is provided in a side wall, and the gap is formed adjacent to a platform of the cage.

4. The elevator car according to claim 1 further comprising a connecting member connecting the inner and the outer door with each other so that the inner and the outer doors move together.

5. The elevator car according to claim 4, wherein the connecting member includes a vibration-isolating element that prevents transmission of vibrations from the outer door to the inner door.

6. The elevator car according to claim 5, wherein the vibration-isolating element is selected from the group consisting of an oil-damper, a spring and a rubber.

7. The elevator car according to claim 1 further comprising a door position detecting switch that detects a position of at least one of the inner door and the outer door.

8. The elevator car according to claim 1, wherein the outer door is pivotally mounted on the outer wall element, and a pivotal axis of the outer door is located in the space between the inner and the outer doors.

9. The elevator car according to claim 1, wherein the inner door is pivotally mounted on the inner wall element, and a pivotal axis of the inner door is located in the space between the inner and the outer doors.

10. The elevator car according to claim 4, wherein the inner and the outer doors are pivotally mounted on the inner and the outer wall elements, respectively, and pivotal axes of the inner and outer doors are located in the space between the inner and the outer doors and are aligned with each other.

11. The elevator car according to claim 4, wherein the inner and the outer doors are pivotally mounted on the inner and the outer wall elements, respectively, so that the doors open toward the interior space of the cage, and the outer door has an area smaller than that of the inner door.

12. The elevator car according to claim 4, wherein the inner and the outer doors are pivotally mounted on the inner and the outer wall elements, respectively, so that the doors open toward an exterior space of the cage, and the inner door has an area smaller than that of the outer door.

13. The elevator car according to claim 1 further comprising:

an actuator that operates to open the inner and the outer doors or to set the inner and the outer door in a state that permits opening the inner and the outer doors, when the elevator car stops in case of emergency; and a door stopper that prevents the inner and the outer door from opening beyond a predetermined position.

14. The elevator car according to claim 1, wherein the cage is provided with an duct passage connecting the interior space of the cage and an external space of the cage, the duct is provided with a valve that closes the duct, and wherein the valve is opened to equalize pressures in the interior and the external spaces when the elevator car stops in case of emergency.

15. The elevator car according to claim 1, wherein a packing is provided between the outer wall element and the outer door so that the outer wall element and the outer door hermetically engage with each other.

16. The elevator car according to claim 1, wherein one of the outer wall element and the outer door is provided with an electromagnet that attracts the other of the outer wall element and the outer door so that the outer wall element and the outer door hermetically engage with each other.

* * * * *